US008869346B2

(12) United States Patent
Han et al.

(10) Patent No.: US 8,869,346 B2
(45) Date of Patent: Oct. 28, 2014

(54) VACUUM CLEANER HAVING CYCLONE DUST COLLECTING APPARATUS

(75) Inventors: Jung-gyun Han, Gwangju (KR); Ki-man Kim, Gwangju (KR); Dong-jun Kim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 99 days.

(21) Appl. No.: 13/324,226

(22) Filed: Dec. 13, 2011

(65) Prior Publication Data

US 2012/0284955 A1 Nov. 15, 2012

(30) Foreign Application Priority Data

May 12, 2011 (KR) ..... 2011-0044806

(51) Int. Cl.

| | |
|---|---|
| ***A47L 9/16*** | (2006.01) |
| ***A47L 5/36*** | (2006.01) |
| ***A47L 9/00*** | (2006.01) |

(52) U.S. Cl.

CPC ..... *A47L 9/009* (2013.01); *A47L 9/1625* (2013.01); *A47L 9/1683* (2013.01); *A47L 9/1608* (2013.01); *A47L 5/362* (2013.01)

USPC ..... 15/353; 15/347

(58) Field of Classification Search

None

See application file for complete search history.

(56) References Cited

U.S. PATENT DOCUMENTS

| | | | | |
|---|---|---|---|---|
| 6,530,292 | B1 | 3/2003 | Loeffler et al. | |
| 6,572,668 | B1 | 6/2003 | An et al. | |
| 7,753,976 | B2 * | 7/2010 | Hyun et al. | 55/343 |
| 7,776,121 | B2 | 8/2010 | Yun et al. | |
| 2002/0189451 | A1 | 12/2002 | Morgan | |
| 2006/0037479 | A1 * | 2/2006 | Song et al. | 96/385 |
| 2008/0010957 | A1 | 1/2008 | Yun et al. | |
| 2008/0172824 | A1 * | 7/2008 | Yun et al. | 15/352 |
| 2008/0184893 | A1 * | 8/2008 | Oh et al. | 96/416 |

FOREIGN PATENT DOCUMENTS

| | | |
|---|---|---|
| EP | 1 457 150 | 3/2004 |
| FR | 1 378 555 | 12/1963 |
| JP | 2003-112082 | 4/2003 |

(Continued)

OTHER PUBLICATIONS

Extended European Search Report issued Mar. 27, 2014 in corresponding European Application No. 12158335.5.

*Primary Examiner* — Monica Carter

*Assistant Examiner* — Stephanie Berry

(74) *Attorney, Agent, or Firm* — Staas & Halsey LLP

(57) ABSTRACT

A vacuum cleaner includes a suction body to draw in dust along with air from a surface to be cleaned; a cleaner body having a suction motor; and a cyclone dust collecting apparatus detachably coupled in the cleaner body. The cyclone dust collecting apparatus includes a cyclone unit to form a first current turning in a first direction to separate the dust and the air drawn therein from each other and having a dust outlet to discharge the dust separated from the air; and a dust collecting unit to collect the dust discharged from the dust outlet. The dust outlet has a side formed adjacent to an inner wall of the dust collecting unit to form a second current turning in a second direction opposite to the first direction to allow the dust discharged through the dust outlet to whirl along the inner wall of the dust collecting unit.

7 Claims, 5 Drawing Sheets

(56) References Cited

FOREIGN PATENT DOCUMENTS

| | | |
|---|---|---|
| JP | 2003-236410 | 8/2003 |
| KR | 10-2002-0008119 | 1/2002 |
| KR | 10-2007-0099321 | 10/2007 |
| WO | WO 99/42198 | 8/1999 |
| WO | WO 00/49933 | 8/2000 |

* cited by examiner

VACUUM CLEANER HAVING CYCLONE DUST COLLECTING APPARATUS

CROSS-REFERENCE TO RELATED APPLICATIONS

This application claims the benefit under 35 U.S.C. §119 (a) of Korean Patent Application No. 10-2011-0044806, filed on May 12, 2011, in the Korean Intellectual Property Office, the entire content of which is hereby incorporated by reference.

BACKGROUND

1. Field

The present disclosure relates to a vacuum cleaner having a cyclone dust collecting apparatus. More particularly, the present disclosure relates to a vacuum cleaner having a cyclone dust collecting apparatus, which is disposed to centrifugally separate and collect a dirt or dust from a drawn-in air.

2. Description of the Related Art

In general, a vacuum cleaner is provided with a cyclone dust collecting apparatus, which is semi-permanently used if there is no dust bag used therein. Such a cyclone dust collecting apparatus is used in a state where it is disposed in a gravity direction, that is, a vertical direction, when it is mounted and used in a cleaner body.

If the cyclone dust collecting apparatus is vertically mounted in the cleaner body to be used in the state where it is disposed in the vertical direction as described above, in order to perform to the best of its dust separating ability, it should be designed to increase in height. In this case, there was a problem in that since the cleaner body increases in entire size, it is difficult to compactly design the vacuum cleaner.

To address the problem in that the cleaner body increases in entire size as described above, there has been proposed a vacuum cleaner with a structure in which the cyclone dust collecting apparatus is horizontally mounted in the cleaner body. In this cyclone dust collecting apparatus, a dust or dirt separated from an air in a cyclone unit is dropped in the gravity direction and collected.

However, to allow the cleaner body to be compactly maintained in size, the cyclone dust collecting apparatus is generally made in a small size. In the cyclone dust collecting apparatus having such a small size, there was a problem in that since the collected dust or dirt may be influenced by a turning current in the cyclone unit thus to scatter or fly upward again, it cannot efficiently perform its dust separating function.

SUMMARY

An aspect of the present disclosure is to address at least the above problems and/or disadvantages and to provide at least the advantages described below. Accordingly, an aspect of the present disclosure is to provide a vacuum cleaner having a cyclone dust collecting apparatus, which is disposed to be inclined in a predetermined angle in a cleaner body, thereby allowing the cleaner body to be compactly maintained in entire size, and which is able to induce air currents in a cyclone unit and a collecting unit to be formed in opposite directions to each other, thereby preventing a collected dust or dirt from scattering or flying upward again.

According to an aspect of the present disclosure, a vacuum cleaner includes a suction body to draw in a dust or dirt along with an air from a surface to be cleaned; a cleaner body having a suction motor therein, the suction body being connected to a side of the cleaner body; and a cyclone dust collecting apparatus detachably coupled in the cleaner body, the cyclone dust collecting apparatus includes a cyclone unit to form a first current turning in a first direction thus to separate the dust or dirt and the air drawn therein from each other and having a dust outlet to discharge the dust or dirt separated from the air; and a dust collecting unit to collect the dust or dirt discharged from the dust outlet, and the dust outlet has a side formed adjacent to an inner wall of the dust collecting unit to form a second current turning in a second direction opposite to the first direction thus to allow the dust or dirt discharged through the dust outlet to whirl along the inner wall of the dust collecting unit in the dust collecting unit.

The dust outlet preferably includes an extension rib to guide the dust or dirt toward the inner wall of the dust collecting unit.

The dust collecting unit may include a first guide disposed in the same plane as that of the extension rib; and a second guide extended to the first guide to change a moving direction of the dust or dirt traveling along the first guide.

The first guide may be formed of a flat plate to guide the dust or dirt in a linear direction, and the second guide may be formed of a curved surface to change the moving direction of the dust or dirt guided in the linear direction by the first guide thus to allow the dust or dirt guided in the linear direction to proceed toward an inner wall portion facing the first guide among the inner wall of the dust collecting unit.

The second guide may be formed of a portion of the inner wall of the dust collecting unit.

The cyclone unit may be disposed to be biased to one side in the dust collecting unit.

The cyclone dust collecting apparatus may be coupled in an inclined state in the cleaner body. In this case, the cyclone dust collecting apparatus may be disposed to be inclined in an angle from 60°~85° to a line L vertical to a ground when the cleaner body lies down on the ground.

As described above, in the present disclosure, as the cyclone dust collecting apparatus is disposed to be inclined in the angle from 60°~85° to the line L vertical to the ground when mounted in the cleaner body, there are advantages in that the cleaner body can be compactly maintained in entire size, and the air currents in the cyclone unit and the dust collecting unit can be formed in opposite directions to each other thus to prevent the dust or dirt collected in a duct collecting chamber from scattering or flying upward again.

BRIEF DESCRIPTION OF THE DRAWINGS

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION

Hereinafter, a type vacuum cleaner having a cyclone dust collecting apparatus according to certain exemplary embodiments of the present disclosure will be described in detail with reference to the accompanying drawing figures.

In the following description, the matters defined in the description, such as detailed construction and elements, are provided to assist in a comprehensive understanding of the invention. However, the present disclosure can be practiced without those specifically defined matters. Also, well-known functions or constructions are not described in detail since they would obscure the invention with unnecessary detail.

Figure 1:
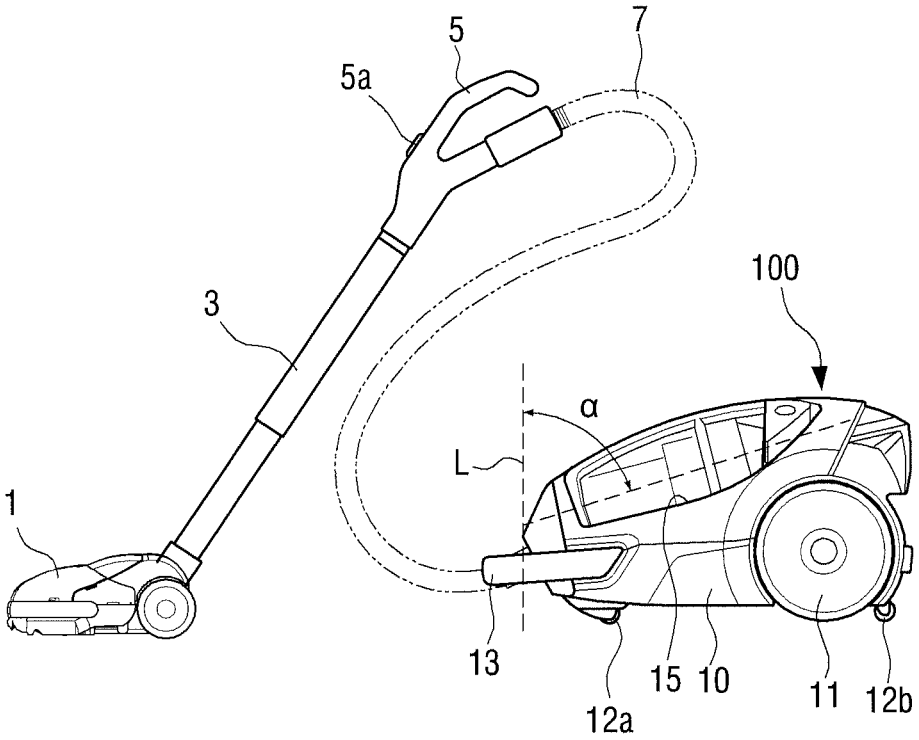
FIG. 1 is a view showing a vacuum cleaner according to an exemplary embodiment of the present disclosure.

Referring to FIG. 1, a vacuum cleaner according to an exemplary embodiment of the present disclosure includes a suction body 1, an extended pipe 3, a handle assembly 5, a connection hose 7, a cleaner body 10 and a cyclone dust collecting apparatus 100.

To draw in a dust or dirt from a surface to be cleaner, such as a floor, the suction body 1 has a suction inlet formed at a bottom surface thereof. The extended pipe 3 has a telescopic structure to be variable in length, and at one side thereof is connected to be hinged to a side of the suction body 1.

The handle assembly 5 at one side thereof is communicated with the other side of the extended pipe 3, and can manipulate a movement of the suction body 1. In this case, the handle assembly 5 is provided with a control switch 5*a* capable of turning on and off the vacuum cleaner and adjusting a strength of a suction force.

The connection hose 7 connects between the handle assembly 5 and the cleaner body 100, and guides the dust or dirt and air drawn-in from the suction body 1 into the cleaner body 10.

The cleaner body 10 has main wheels 11 and subsidiary wheels 12*a* and 12*b* installed at both sides and at the front and the rear of a bottom surface thereof, respectively, to be movable along the surface to be cleaner. In addition, the cleaner body 10 has an accommodating part 15 in which the cyclone dust collecting apparatus 100 is detachably coupled along a longitudinal direction thereof.

In this case, the cyclone dust collecting apparatus 100 is maintained to be inclined in a predetermined angle, for example, an angle from 60°~85° to a line L vertical to a ground, that is, the surface to be cleaned, when it is coupled in the accommodating part 15.

The cleaner body 10 is moved in a state where it lies down on the surface to be cleaned when a user cleans the surface to be cleaned with the vacuum cleaner, and in a state where it stands vertically with a handle 13 formed at the front thereof grasped by user's hand when the user holds and moves the cleaner body 10 directly.

Hereinafter, a configuration of the cyclone dust collecting apparatus 100 will be described in detail with reference to FIGS. 2 to 5.

Figure 2:
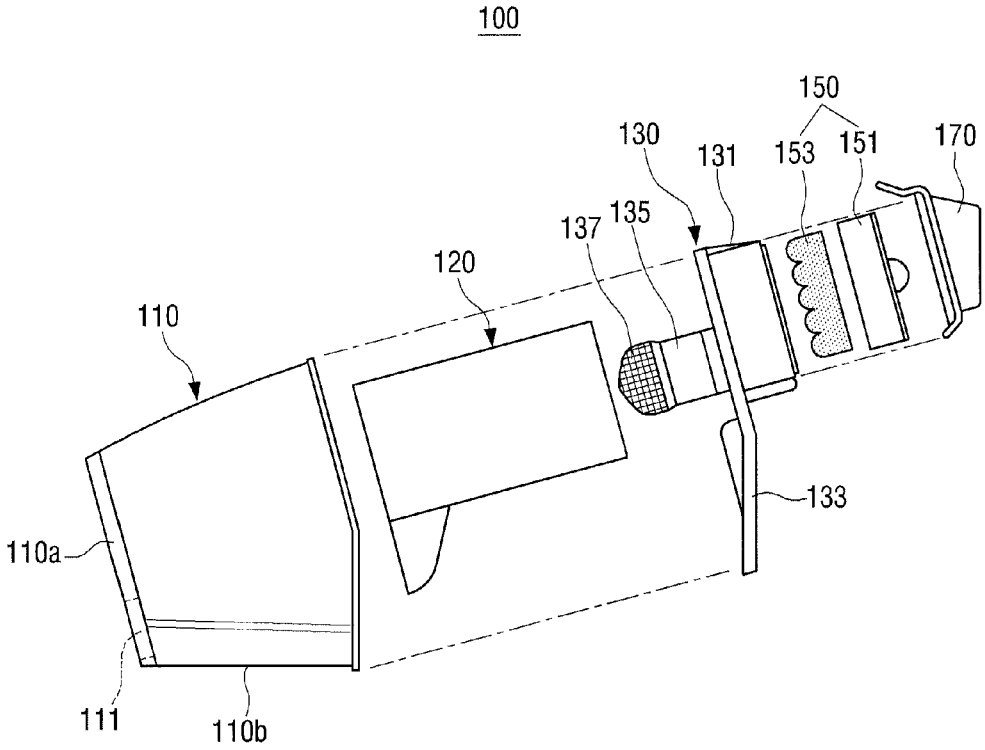
FIG. 2 is an exploded view showing a cyclone dust collecting apparatus of the vacuum cleaner according to the exemplary embodiment of the present disclosure.

Referring to FIG. 2, the cyclone dust collecting apparatus 100 includes a dust collecting unit 110, a cyclone unit 120, an air discharging unit 130, a fine dust filter unit 150, and a cover 170.

Figure 3:
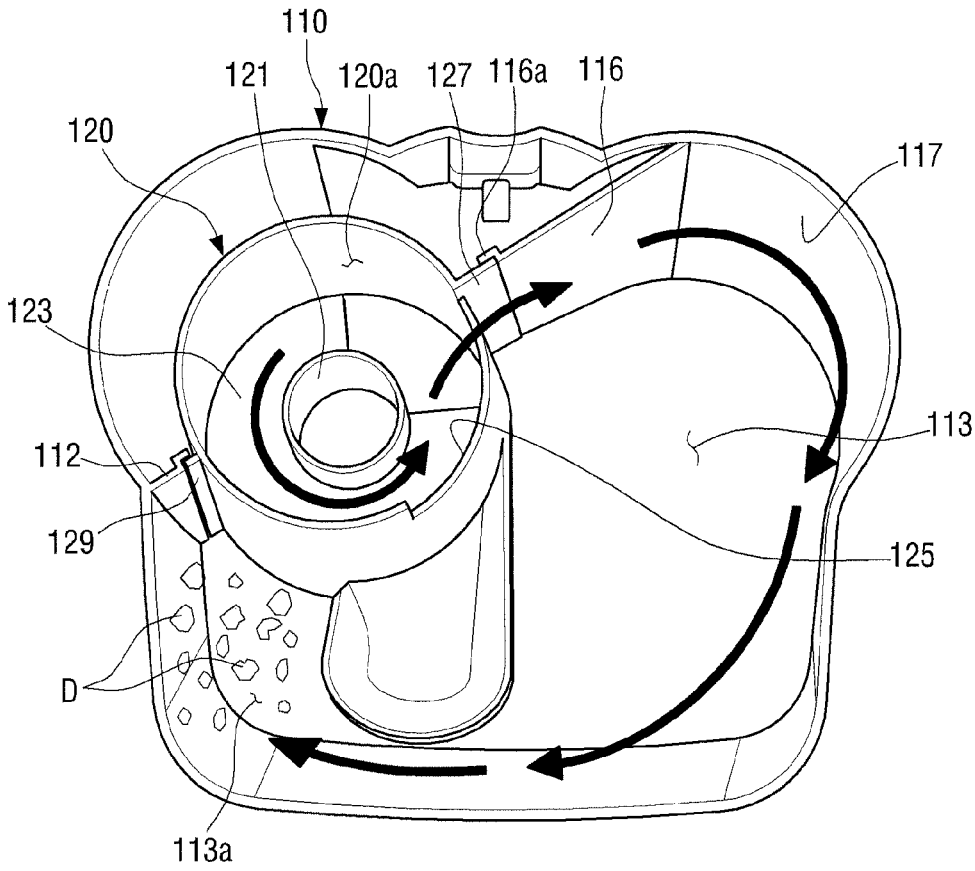
FIG. 3 is a top plan cross-sectional view showing the cyclone dust collecting apparatus of the vacuum cleaner according to the exemplary embodiment of the present disclosure.

Referring to FIG. 3, the dust collecting unit 110 is formed in a tub shape having an one side opened, and at the other side 110*a* thereof closed is formed an inlet 111 into which the dust or dirt and air drawn into the cleaner body 10 are flowed. The dust collecting unit 110 has a coupling part 112 formed at and projected from a portion of an inner circumferential surface thereof to support one side of the cyclone unit 120 by being coupled to rib 129. In this case, the coupling part 112 supports the cyclone unit 120 along with a first guide 116 to be described later.

Figure 4:
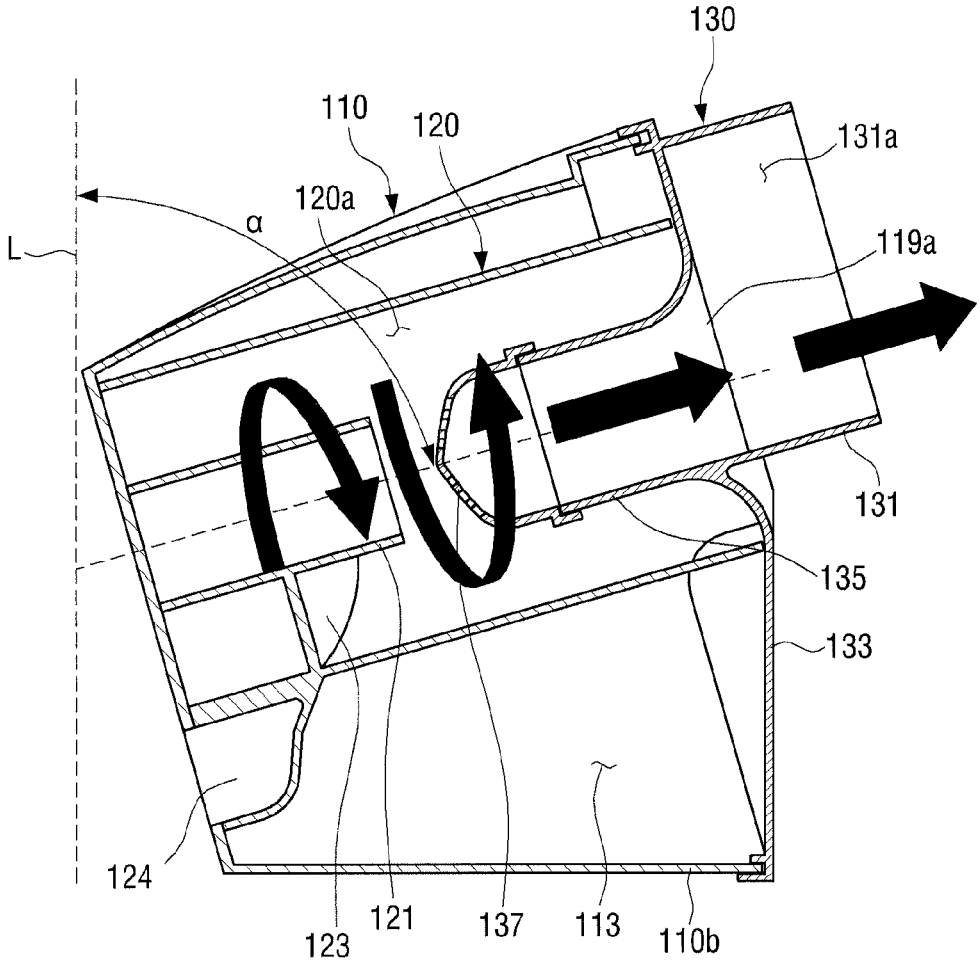
FIG. 4 is a side cross-sectional view showing the cyclone dust collecting apparatus of the vacuum cleaner according to the exemplary embodiment of the present disclosure.

Also, referring to FIG. 4, when the cyclone dust collecting apparatus 100 is mounted in the accommodating part 15 of the cleaner body 10, the dust collecting unit 110 is positioned, so that side surface 110*b* and rear surface 133 thereof are seated on a bottom and rear surface of the accommodating part 15. According to this, the cyclone dust collecting apparatus 100 is disposed to be inclined in the angle from 60°~85° to the line L vertical to the surface to be cleaned, as described above. In this case, if the inclined angle of the cyclone dust collecting apparatus 100 is less than 60°, the cleaner body increases in entire size due to the height of the cyclone dust collecting apparatus 100, and if the inclined angle exceeds 85°, a problem occurs in that the dust or dirt collected in the dust collecting unit scatters or flies upward again, as in the conventional cyclone dust collecting apparatus.

The first guide 116 is formed of a certain flat plate to guide the dust or dirt discharged from a dust outlet 125 of the cyclone unit 120 in a linear direction.

A second guide 117 is formed of a curved surface to change the moving direction of the dust or dirt guided in the linear direction by the first guide 116 thus to allow the dust or dirt guided in the linear direction to proceed toward an inner wall portion facing the first guide 116 among the inner wall of the dust collecting unit 110. In this case, the second guide 117 is formed of a portion of the inner wall of the dust collecting unit 110. However, the present disclosure is not limited thereto, but it is also possible for the second guide to be formed of a curved member extended from the inner wall of the dust collecting unit 110, like the first guide 116.

The cyclone unit 120 is formed in an approximately circular shape, and is coupled to a position where it is biased to one side in the dust collecting unit 110. In the cyclone unit 120 is formed a cyclone chamber 120*a* for centrifugally separating the dust or dirt from the air current, and in the cyclone chamber 120*a* are formed a cylindrical guide 121 coaxially disposed with the cyclone unit 120 and a spiral guide 123.

The spiral guide 123 is spirally formed along an outer circumference of the cylindrical guide 121, so that the air laden with the dust or dirt drawn into the cyclone chamber 120*a* through an inflow hole 124 formed on a lower end of the cyclone unit 120 is applied with a turning force while moving in a certain speed along the spiral guide 123. Such a turning force forms an air current, which turns in one direction in the cyclone chamber 120*a*.

Figure 5:
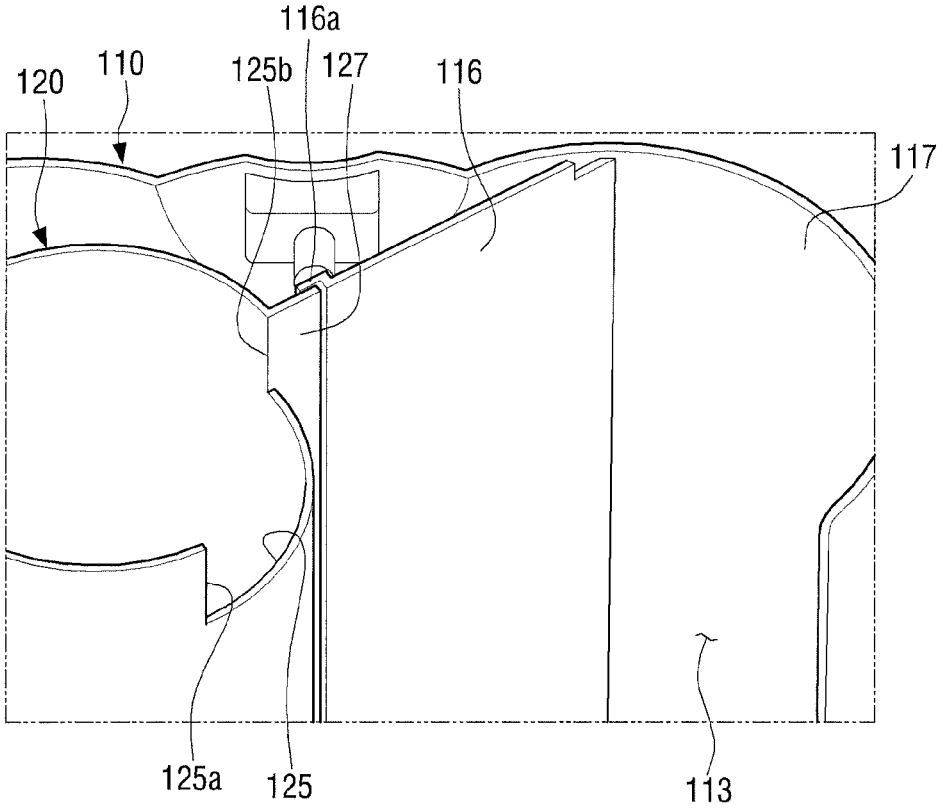
FIG. 5 is a partially magnified perspective view showing a portion of the cyclone dust collecting apparatus of the vacuum cleaner according to the exemplary embodiment of the present disclosure.

Also, the cyclone unit 120 has a dust outlet 125 formed at a side of a top end thereof to discharge the dust or dirt separated from the air by the centrifugal force in the cyclone chamber 120*a*. Referring to FIG. 5, the dust outlet 125 is positioned to approximately face the second guide 117 of the dust collecting unit 110, and is formed in a predetermined length from one side end 125*a* to the other side end 125*b* thereof. In this case, an extension rib 127 is formed on and extended from the other side end 125*b* of the dust outlet 125 to guide the dust or dirt discharged from the dust outlet 125 toward the first guide 116. At this time, the extension rib 127 is fixed by a coupling part 116*a* formed along an end tip of the first guide 116.

On the other hand, referring to FIG. 3, a first air current, which turns counterclockwise, is formed in the cyclone chamber 120*a*, and a second air current, which turns clockwise, is formed in a dust collecting chamber 113 of the dust collecting unit 110. The reason why the rotary directions of the air currents are changed as described above is that the dust or dirt D discharged into the dust collecting chamber 113 through the dust outlet 125 is traveled in the linear direction along the first guide 116, but guided clockwise by the second guide 117 to cause the rotary direction of the second air current to be formed opposite to that of the first air current.

In this case, the dust or dirt D is dropped in a gravity direction in the dust collecting chamber 113, and then consistently collected into a corner 113*a* of a side of the dust collecting chamber 113 where the cyclone unit 120 is located. Accordingly, as the rotary directions of the first and the second air currents in the cyclone chamber 120*a* and the dust collecting chamber 113 are formed opposite to each other, the dust or dirt D cannot only be efficiently collected in the small size dust collecting chamber 113, but also can be prevented from scattering or flying upward again.

Referring to FIG. 4, the air discharging unit 130 is detachably coupled in an opened portion of the cyclone unit 120. The air discharging unit 130 has a filter mounting part 131 where the fine dust filter part 150 is mounted, and a discharging pipe 135 extended from the filter mounting part 131 and inserted into the cyclone chamber 120*a*.

The discharging pipe 135 has an inlet to which the grill filter 137 is coupled, so that a dust or dirt, which is not centrifugally separated in the cyclone unit 120, is filtered from the air flowed into the discharging pipe 135. In this case, the discharging pipe 135 is concentrically positioned with the cylindrical guide 121 of the cyclone unit 120.

The fine dust filter part 150 (see FIG. 2) includes a filter support 151 detachably inserted in an inner side 131*a* of the filter mounting part 131 and a filter 153 inserted in the filter support 151. In this case, the filter 153, which filters a fine dust or dirt laden with the air discharged from the discharging pipe 135 through a passage 119*a* (see FIG. 4), may be made up of, for example, a HEFA filter.

The cover 170 is detachably coupled to the filter mounting part 131, and prevents the fine dust filter part 150 from being released from the filter mounting part 131.

As apparent from the foregoing description, the vacuum cleaner according the exemplary embodiment of the invention disclosure is configured, so that the cyclone dust collecting apparatus 100 is disposed to be inclined in the angle from 60°~85° to the line L vertical to the surface to be cleaned, thereby allowing the cleaner body to be compactly maintained in entire size, when mounted in the accommodating part 15 of the cleaner body 10, and so that the air currents in the cyclone chamber 120*a* and the dust collecting chamber 113 can be formed in opposite directions to each other, thereby preventing the dust or dirt collected in the duct collecting chamber 113 from scattering or flying upward again.

Although representative embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A vacuum cleaner, comprising:

a suction body to draw in a dust or dirt along with an air from a surface to be cleaned;

a cleaner body having a suction motor therein, the suction body being connected to a side of the cleaner body; and a cyclone dust collecting apparatus detachably coupled in the cleaner body, wherein the cyclone dust collecting apparatus comprises a cyclone unit to form a first current turning in a first clockwise or counterclockwise direction to separate the dust or dirt and the air drawn therein from each other and having a dust outlet to discharge the dust or dirt separated from the air; and a dust collecting unit to collect the dust or dirt discharged from the dust outlet, and wherein the dust outlet has a side formed adjacent to an inner wall of the dust collecting unit to form a second current turning in a second counterclockwise or clockwise direction opposite to the first clockwise or counterclockwise direction thus to allow the dust or dirt discharged through the dust outlet to whirl along the inner wall of the dust collecting unit in the dust collecting unit, and the cyclone dust collecting apparatus is coupled in an inclined state in the cleaner body relative to a line vertical to a ground when the cleaner body lies down on the ground.

2. The cleaner as claimed in claim 1, wherein the dust outlet comprises an extension rib to guide the dust or dirt toward the inner wall of the dust collecting unit.

3. The cleaner as claimed in claim 2, wherein the dust collecting unit comprises:

a first guide disposed in a same plane as that of the extension rib; and a second guide extended to the first guide to change a moving direction of the dust or dirt traveling along the first guide.

4. The cleaner as claimed in claim 3, wherein the first guide is formed of a flat plate to guide the dust or dirt in a linear direction, and the second guide is formed of a curved surface to change the moving direction of the dust or dirt guided in the linear direction by the first guide thus to allow the dust or dirt guided in the linear direction to proceed toward an inner wall portion facing the first guide among the inner wall of the dust collecting unit.

5. The cleaner as claimed in claim 4, wherein the second guide comprises a portion of the inner wall of the dust collecting unit.

6. The cleaner as claimed in claim 1, wherein the cyclone unit is disposed to be biased to one side in the dust collecting unit.

7. The cleaner as claimed in claim 1, wherein the cyclone dust collecting apparatus is disposed to be inclined in an angle from 60°-85° to the line vertical to the ground when the cleaner body lies down on the ground.

* * * * *

UNITED STATES PATENT AND TRADEMARK OFFICE

CERTIFICATE OF CORRECTION

PATENT NO. : 8,869,346 B2
APPLICATION NO. : 13/324226
DATED : October 28, 2014
INVENTOR(S) : Jung-gyun Han et al.

It is certified that error appears in the above-identified patent and that said Letters Patent is hereby corrected as shown below:

In the Claims

Column 6, line 58, in Claim 7, delete "60°-85°" and insert -- 60°~85° --, therefor.

Signed and Sealed this
Nineteenth Day of May, 2015

Michelle K. Lee

Michelle K. Lee
*Director of the United States Patent and Trademark Office*